United States Patent [19]

Arthurs et al.

[11] Patent Number: 4,722,420

[45] Date of Patent: Feb. 2, 1988

[54] SPECIAL PURPOSE LADDER

[76] Inventors: Trudy Arthurs; Harold S. Swartz, both of P.O. Box 30165 Station B, Calgary, Alberta, Canada, T2M 4P1

[21] Appl. No.: 931,132

[22] Filed: Nov. 17, 1986

[51] Int. Cl.[4] ..... E06C 5/36; E06C 7/48

[52] U.S. Cl. ..... 182/93; 182/201; 182/116; 182/187; 182/206

[58] Field of Search ..... 182/93, 206, 204, 201, 182/116, 187

[56] References Cited

U.S. PATENT DOCUMENTS

| | | | |
|---|---|---|---|
| 347,608 | 8/1886 | Jackson | 182/93 |
| 1,138,583 | 5/1915 | Tasker | 182/93 |
| 1,142,072 | 6/1915 | Wingerd | 182/206 |
| 3,268,196 | 8/1966 | Anton | 182/206 |

FOREIGN PATENT DOCUMENTS

| | | | |
|---|---|---|---|
| 245107 | 7/1911 | Fed. Rep. of Germany | 182/93 |
| 1131322 | 9/1955 | France | 182/201 |
| 1313696 | 11/1962 | France | 182/93 |

*Primary Examiner*—Reinaldo P. Machado

[57] ABSTRACT

This ladder is designed to clamp to sign posts for workman safety. Primarily, it consists of a pair of stepped legs with a hinged shelf at the top having a clamp that clamps to a sign post. A second clamp is also provided below and is secured to arms attached to the legs, and a pair of extension rods are provided on the legs for stabilily of the legs on sloping ground surfaces.

2 Claims, 3 Drawing Figures

SPECIAL PURPOSE LADDER

BACKGROUND OF THE INVENTION

1. Field of the Invention

This invention relates to ladders, and more specifically, to a special purpose ladder.

2. Description of Prior Art

Ladders are known in the art and are basically the same. The ladder in accordance with the present invention, is specifically designed for aiding workmen to safely service roadside signs.

The principal object of this invention is to provide a special purpose ladder that a workman can safely employ to service roadside signs that are usually located on sloping terrain.

Another object of this invention is to provide a special purpose ladder, which will include clamp means for securement of the ladder to a sign post, and if the sign post is strong and solidly implanted, the design is such, that the legs of the ladder need not touch the ground while supporting two average weight workmen.

SUMMARY OF THE INVENTION

Figure 1:
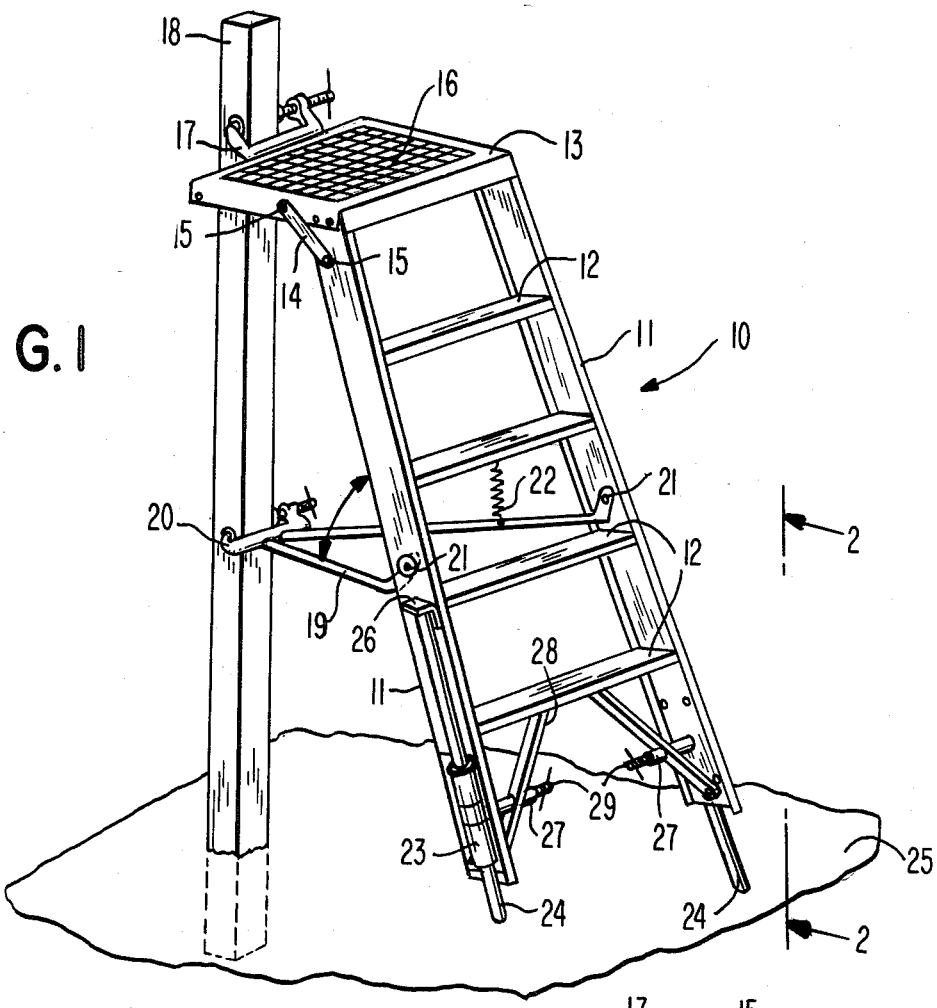
FIG. 1 is a perspective view of the present invention.
Figure 2:
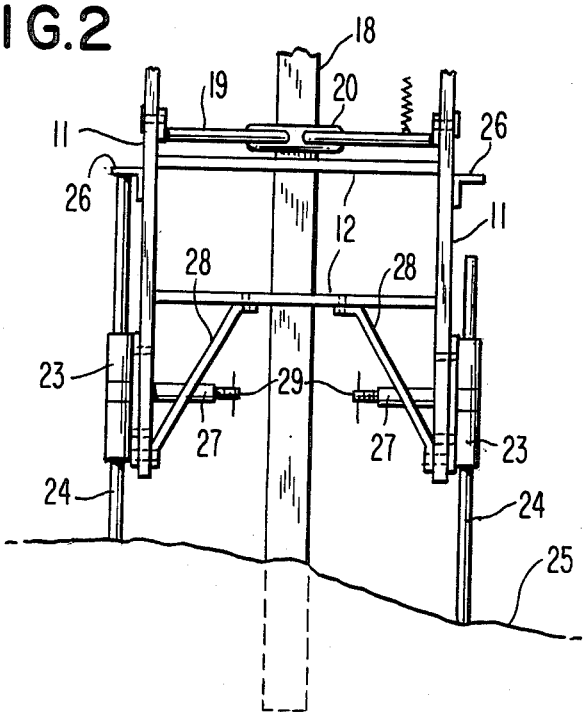
FIG. 2 is a view taken along the line 2—2 of FIG. 1.
Figure 3:
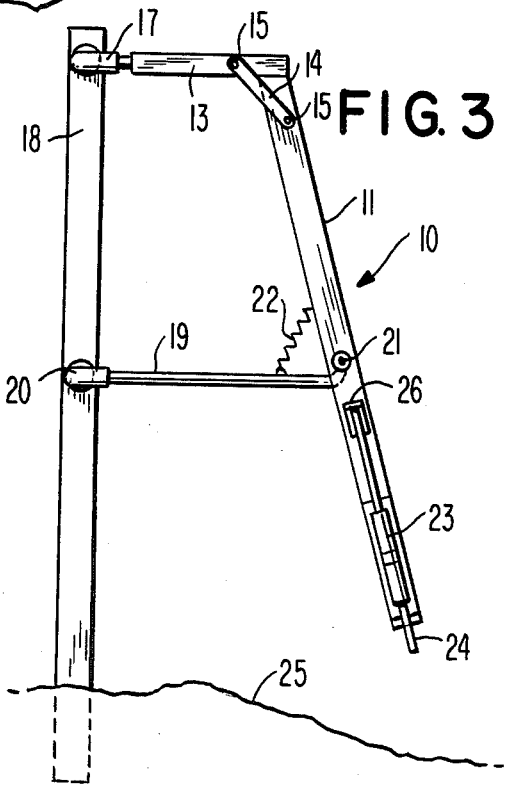
FIG.3 is a side view of the invention, illustrating its feet off the ground surface.

A special purpose ladder, comprising side members with steps and a platform or shelf on the top, and clamp means are provided to engage with a sign post to support the ladder therefrom.

DETAILED DESCRIPTION

Accordingly, a ladder 10 is shown to include a pair of legs 11 having steps 12 fixedly secured therebetween. A shelf 13 is pivotally secured to the tops of legs 11 by hinge rods 14 fastened thereto, by fasteners 15. An abrasive 16 is applied to the top of shelf 13, so as to prevent tools and the like from falling therefrom, and an adjustable clamp 17 is fixedly secured to the rear end of shelf 13, for clamping to a square wooden sign post 18. A pair of brace arms 19 are secured fixedly to a second adjustable clamp 20, providing a secondary means for holding ladder 10 to post 18, and the ends of arms 19 are pivotally secured to legs 11 by fasteners 21. A stop chain 22 is also fastened to one arm 19 and to a step 12 for limiting downward travel of arms 19, clamp 20.

A sleeve 23 is fixedly secured to each side of the bottom portions of legs 11, and an extension rod 24 is slideable in each sleeve 23, for holding ladder 10 firmly on sloping ground 25. The rods 24 are prevented from traveling too far upward, by stop brackets 26 that are fixedly secured in a suitable manner to the sides of legs 11. Sleeves 23 include an internally threaded projection 27 that is secured in brackets 28 fastened fixedly to legs 11 and the lower step 12, and a set bolt 29 is received in projections 27 for securing rods 24 at any elevation desired in sleeves 23.

In use, the clamps 17 and 20 are tightened on the post 18 after pivoting out the shelf 13 and the rods 19. If the ground 25 is uneven, the rods 24 are adjusted in elevation by the set bolts 29.

While various changes may be made in the detail construction, such changes will be within the spirit and scope of the present invention, as defined by the appended claims.

What we now claim is:

1. A special purpose ladder, comprising, a pair of legs, a plurality of rungs interconnecting said legs, a shelf fixedly secured at one edge to the top of said legs, a first clamp fixedly secured to another edge of said shelf, a second clamp located below said first clamp and pivotally secured by a pair of arms to said legs by suitable fasteners, a pair of extension rods slideably received in sleeves fixedly secured longitudinal to the sides of the lower portions of said legs, and said extension rods provide a means of engaging with a sloping ground surface to stabilize said ladder; whereby said ladder could be clamped to a single post by means of said clamps.

2. A special purpose ladder as set forth in claim 1, wherein each said extension rod is secured at any desired extension by means of a set bolt, said set bolt is received into an internally threaded projection fixedly secured to said sleeves at right angle and extending through an opening through said legs, and said set bolt which when tightened impinges against a floating collar surrounding the said extension rod wedging the said extension rod secure against the said sleeves.

* * * * *